United States Patent [19]

Ieda et al.

[11] Patent Number: 4,990,927

[45] Date of Patent: Feb. 5, 1991

[54] MICROSTRIP ANTENNA

[75] Inventors: Kiyokazu Ieda, Tokyo; Yuichi Murakami, Kanagawa; Takashi Nakamura, 3680-15, Honjyo, Gifu City, Gifu Pref., all of Japan

[73] Assignees: Takashi Nakamura, Gifu; Aisin Seiki Kabushiki Kaisha, Kariya, both of Japan

[21] Appl. No.: 328,641

[22] Filed: Mar. 27, 1989

[30] Foreign Application Priority Data

Mar. 25, 1988 [JP] Japan ..... 63-071015
Mar. 25, 1988 [JP] Japan ..... 63-071016

[51] Int. Cl.[5] ..... H01Q 1/38

[52] U.S. Cl. ..... 343/700 MS; 343/830; 343/846

[58] Field of Search ..... 343/700 MS File, 829, 343/846, 830, 749

[56] References Cited

U.S. PATENT DOCUMENTS 4,259,670 3/1981 Schiavone ..... 343/700 MS
4,379,296 4/1983 Farrar et al. ..... 343/700 MS
4,529,987 7/1985 Bhartia et al. ..... 343/700 MS

FOREIGN PATENT DOCUMENTS 1883 5/1979 European Pat. Off. ..... 343/700 MS
1171884 8/1985 U.S.S.R. ..... 343/700 MS

OTHER PUBLICATIONS

Carver et al., "Microstrip Antenna Technology", IEEE Trans. on Antennas and Prop., vol. AP-29, No. 1, Jan. 1981.

Int'l Symposium-Antennas & Propagation, 1976 Amhurst, Mass., Oct. 11-15, 1976, Tokumaru, "Multiplates: Low Profile Antennas", pp. 379-382.

*Primary Examiner*—Michael C. Wimer

*Attorney, Agent, or Firm*—Sughrue, Mion, Zinn, Macpeak & Seas

[57] ABSTRACT

A microstrip antenna has a rectangularly-shaped radiation conductive plate attached to one side of a dielectric plate, with a grounding conductive plate being attached to the other side of the dielectric plate. Rectangular line loads extend from adjacent sides of the radiation conductive plate. With such a configuration, the antenna retains all of the advantages of a microstrip antenna, including light weight, compactness, ease of manufacture, and a low profile, while enabling operation at multiple frequencies (four, on one embodiment), or polarization at multiple frequencies (two, in another embodiment).

5 Claims, 4 Drawing Sheets

MICROSTRIP ANTENNA

BACKGROUND OF THE INVENTION

This invention relates to a microstrip antenna, and especially to a 4 resonance microstrip antenna which can be used at four frequencies. This invention also relates to a polarized wave microstrip antenna which enables polarization with only a single electric supply point.

A microstrip antenna has two conductive plates on both sides of a dielectric plate and uses a radiational loss of an open level resonance circuit Microstrip antennas are particularly useful, because a microstrip antenna is:

(1) low profile (2) light weight and compact and (3) easy to make.

A microstrip antenna has a narrow band width characteristic and works in a special frequency band.

A radio communication system is known which uses waves of many different frequencies. A spectrum diffusion communication system which uses frequency hopping is one such radio communication system. In this system, a signal is diffused directly by a modulation frequency (transmitting frequency) which is hopped by a code series. This requires a radio station which consists of a system having radio transmitting and receiving power at many frequencies.

A microstrip antenna is suitable for a place where there is a limited space for instance a car, in the case of a radio communication using only one frequency, for the above-mentioned reasons. In the case of radio communication using several frequencies such as spectrum diffusion communication by frequency hopping, however, a microstrip antenna is not suitable for a place where there is a restricted space, because a microstrip antenna has a narrow bandwidth characteristic, so that as many elements (radiation conductive elements) are necessary as there are frequency bands.

For example Japanese Laid-Open Patent Application No. 56(1981)-141605 shows a 2 resonance microstrip antenna having an elliptic element which is excited in both a long axis mode and a short axis mode. It is possible to use this antenna in two frequency bands in order to obtain an intersection excitement mode by providing an electric supply point at an intersection of the long axis and the short axis of the ellipse.

Japanese Laid-Open Patent Application No. 59(1984)-126304 shows a 2 resonance microstrip antenna which has two half sized elements and uses an electric image effect. The element size is cut by about half by using an electric image effect which is made by being short at a position where a current distribution of the element is zero so that the 2 frequency microstrip antenna can be made by connecting two half sized elements which resonate at different frequencies, at the short point.

However, the above-mentioned 2 resonance microstrip antenna cannot be used at several frequencies because of its constitution. The latter has two half sized elements separately which resonate at different frequencies, although it has a common short point. There is no reduction of number of elements when the antenna is used at two frequencies. Polarization is either straight line or circular (including an ellipse) according to the shape of the element (radiation conductive element). the electric supply point, and the method of electric supply.

Several frequencies are used at the same time for radio communication, for example in a transmission and reception circuit. In this case, it is necessary to isolate each frequency in order to prevent adverse effects including interference If a polarized wave microstrip antenna were used for this kind of a radio communication system, there would have to be a special polarized wave microstrip antenna for each frequency, because a polarized wave microstrip antenna has a narrow bandwidth characteristic. This means that the microstrip antenna would become large in size, thus losing one advantage of microstrip antennas (light weight and compactness).

Many combinations of polarized wave microstrip antennas have been devised in an attempt to solve this problem. For example, Japanese Laid-Open Patent Application No. 57(1982)-91003 shows a 2 frequency polarized wave microstrip antenna which uses a quadrangle combination of triangle polarized wave microstrip antennas for transmission and reception respectively. It is possible to minimize an increase of space taken by a 2 frequency polarized wave antenna in the former. However, other advantages of the microstrip antenna, such as its low profile, light weight, compactness and ease of manufacture are lost by having such a multistage configuration. With the latter, the overall space required by the microstrip antenna is decreased, because small triangle polarized wave microstrip antennas are used for transmission and reception. However, the space required is greater than that required for a single microstrip antenna.

SUMMARY OF THE INVENTION

Accordingly, one object of the present invention is to provide a 4 resonance microstrip antenna which can be used in four frequency bands and which is highly flexible to enable diversification in a communication system.

Another object of the present invention is to produce a 2 frequency polarized wave microstrip antenna which can be used in two frequency bands without losing any advantages of a microstrip antenna which are its low profile, light weight compactness and ease of manufacture.

To achieve the above objects, and in accordance with the principle of the invention as embodied and broadly described herein a microstrip antenna comprises a dielectric plate member which is held by a radiation conductive plate member and a grounding conductive member and line loads which extend from the middle of the two adjacent sides of the radiation conductive plate member, respectively.

In accordance with the above microstrip antenna, four resonance points are obtained by separating a resonance point into two points in a parallel exciting mode which is parallel to each independent side, because line loads extend from the middle of the two adjacent sides of the radiation conductive plate member, respectively. Therefore, it is able to use the microstrip antenna at four frequencies.

In the present invention, a microstrip antenna does not lose any of its aforememtioned advantages, because the line loads can be made by copper plate which is integrated with a radiation conductive plate member.

To achieve the second object of the invention as embodied and described herein, a microstrip antenna comprises a dielectric plate member which is held by a radiation conductive plate member and a grounding conductive member, a single electric power supply point, and line loads which extend from the middle of the two adjacent sides of the radiation conductive plate member, respectively, and produce 90 degrees phase difference in input admittance in a parallel exciting mode which is parallel to the two adjacent sides. cl

BRIEF DESCRIPTION OF THE DRAWINGS

For a full understanding of the true scope of the invention, the following detailed description should be read in conjunction with the drawings, wherein.

DETAILED DESCRIPTION OF THE PREFERRED EMBODIMENTS

In the following, preferred embodiments of the present invention will be described with reference to the drawings.

Figure 1A:
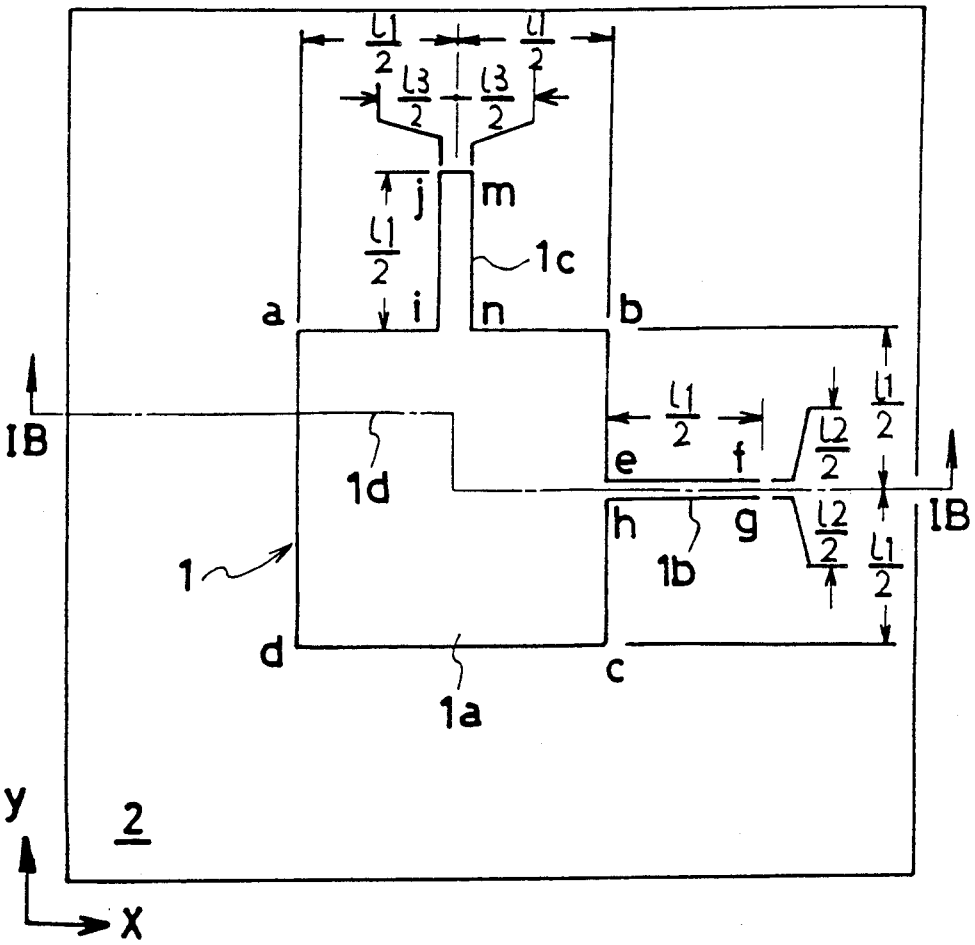
FIG. 1*a* is a plane view and FIG. 1*b* is a sectional view of a microstrip antenna showing one embodiment of the present invention.
Figure 1B:
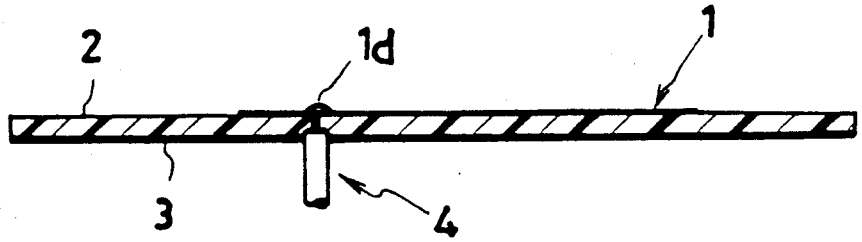

Referring to FIGS. 1*a* and 1*b*, this antenna has a dielectric plate member 2 which has a radiation conductive plate member 1 on one side and a grounding conductive plate 3 on the other side. The radiation conductive plate 1 has a first rectangular part 1*a* as shown by points, a, b, c, and d, a second rectangular part 1*b* as shown by points e, f, g, and h, which extends from a side bc of the rectangular part 1*a*, and a third rectangular part 1*c* as shown by points i, j, m, and n, which extends from a side ab of the first rectangular part 1*a*. Rectangular parts 1*a* and 1*b* have a common X axis center line, and rectangular parts 1*a* and 1*c* have a common Y axis center line. An electric supply point 1*d* is located close to a diagonal line ac, and is brazed with an inner conductive line of a coaxial line 4 which comes through from the back. An outer conductive line of the coaxial line 4 is brazed with the grounding conductive plate 3 which covers the entire back of the dielectric plate 2.

Figure 2:
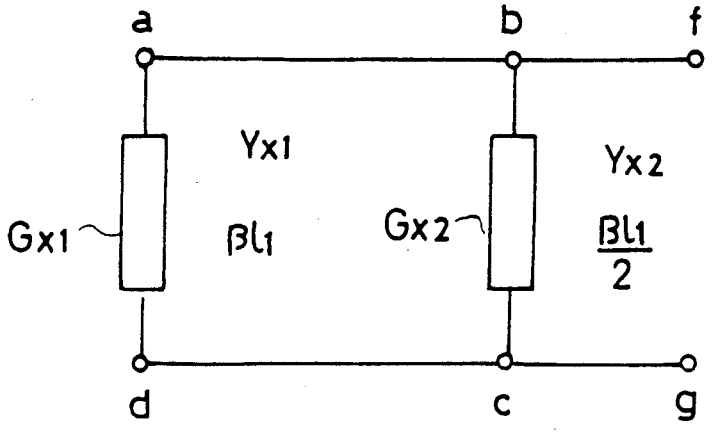
FIG. 2 is an electric circuit equivalent to an X component of a microstrip antenna shown in FIG. 1*a*.

In the embodiment, the size of the radiation conductive plate 1 is as follows. A length of the sides ab, bc, cd, and ad: $l_1=60$ mm; a length of the sides ef, gh, ij, and mn: $l_1/2=30$ mm; a length of the sides fg, and eh: $l_2=3$ mm; and a length of sides in and jm: $l_3=5$ mm. This antenna has a parallel component to the side ab, that is, $TM_{mo}$ mode to the X component, and a parallel component to the side bc, that is, $TM_{on}$ mode to the Y component, independently. Herein, m and n are natural numbers. This embodiment uses $TM_{10}$ and $TM_{01}$ modes ($m=n=1$) as basic modes. As to the X component, this antenna is an equivalent to the circuit shown in FIG. 2, because the rectangular part 1*b* works as a line load. A characteristic admittance $Y\times 1$ with respect to the side ad against the side bc and a characteristic admittance $Y\times 2$ with respect to the side fg against the side bc are shown by the following formulas:

$$Y\times 1=\epsilon rei_1^{\frac{1}{2}}\cdot l_1/(120\pi\cdot t)\ . \quad ..(1)$$

$$Y\times 2=\epsilon rei_1^{\frac{1}{2}}\cdot l_2/(120\pi\cdot t)\ . \quad ..(2)$$

In this case, radio wave radiation is made by the sides ad and bc, and the radiation conductances $G\times 1$ and $G\times 2$ are shown by the following formula:

$$G\times 1=G\times 2=G-Fc.l_1^2/\{90\cdot\lambda o^2\}. \quad ..(3)$$

wherein:

$\epsilon rei_1=(er+1)/2+(\epsilon r-1)/\{2(1+10t/l_1)^{\frac{1}{2}}\}$ $\epsilon rei_2=(er+1)/2+(\epsilon r-1)/\{2(1+10t/l_1)^{\frac{1}{2}}\}$ $\epsilon r$: a dielectric constant of the dielectric plate 2 t: a thickness of the dielectric plate 2

Fc: a correction coefficient to a fringing effect $\lambda o$: a free space wavelength of a resonance frequency Because the resonance frequency is unrelated to the position of an electric supply point, an input admittance Yinx of X component when the electric power is supplied on the side bc is:

$$Yinx \simeq 2G+j\{Y\times 1\cdot\tan(\beta\cdot l_1)+Y\times 2\cdot\tan(l/2)\}. \quad ..(4)$$

wherein, $\beta\cdot l_1\simeq\pi$, $G<<Y\times 1$, $Y\times 2$, and a phase constant $\beta$ is shown as $2\pi/\lambda g$ if a propagation wavelength on the radiation conductive plate 1 is $\lambda g$.

Figure 3:
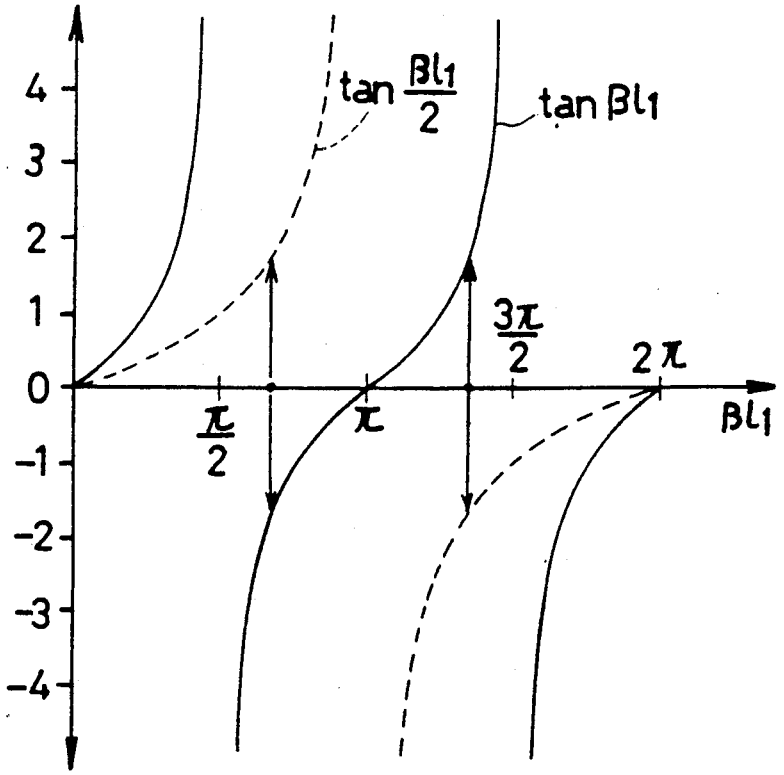
FIG. 3 is a graph related to a size of antenna element and phase constant.

FIG. 3 is a graph showing tan $(\beta\cdot l_1)$ and tan $(\beta\cdot l_1/2)$. Referring to FIG. 3, $\beta\cdot l_1$ which makes an imaginary number term of the formula (4) "0" "(zero) exists at two points on both sides of $\beta\cdot l_1=\pi\cdot\beta\cdot l_1$. A frequency which supplies the value $\beta\cdot l_1$ is a resonance frequency, thus two resonance frequencies exist in the X component. In the same way, two resonance frequencies exist in the Y component, because the rectangular part 1*c* works as a line load. This antenna has four resonance frequencies, because two resonance frequencies exist in each X, Y component.

Figure 4:
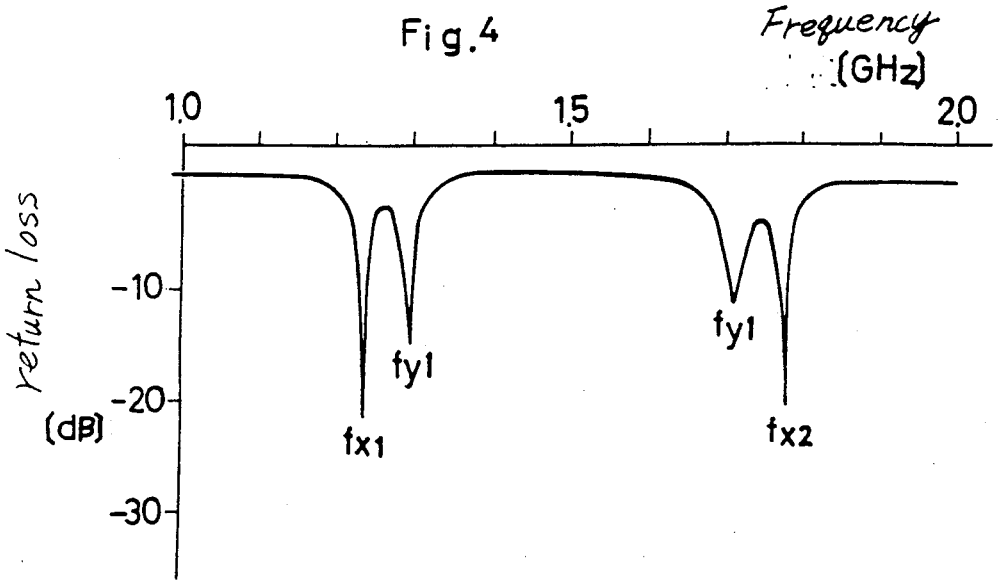
FIG. 4 is a graph showing a correlation betWeen an exciting frequency and a return loss.

FIG. 4 is a graph which shows a return loss when the antenna is excited with 1.0~2.0 GHz frequency. A return loss shows a reflection loss of an electric supply power, therefore 0 dB is equal to the whole reflection. This antenna shows peaks of a return loss in four frequencies $f\times 1$, $f\times 2$, fy1 and fy2, and the antenna resonates at four frequencies. This experimental data shows that this antenna has four resonance frequencies. In this graph $f\times 1$ and $f\times 2$ are resonance frequencies of the X component, and fy1 and fy2 are resonance frequencies of the Y component. Polarized faces of the radiation wave are crossed in 90 degrees, because the exciting modes are crossed in 90 degrees.

In this embodiment, an opening line is used as a line load, but a short line may be used equally well. In that case, a length of each line load, that is, a length of the sides ef, gh, ij, and mn is $l_1$.

A polarized wave microstrip antenna now will be described.

Figure 5:
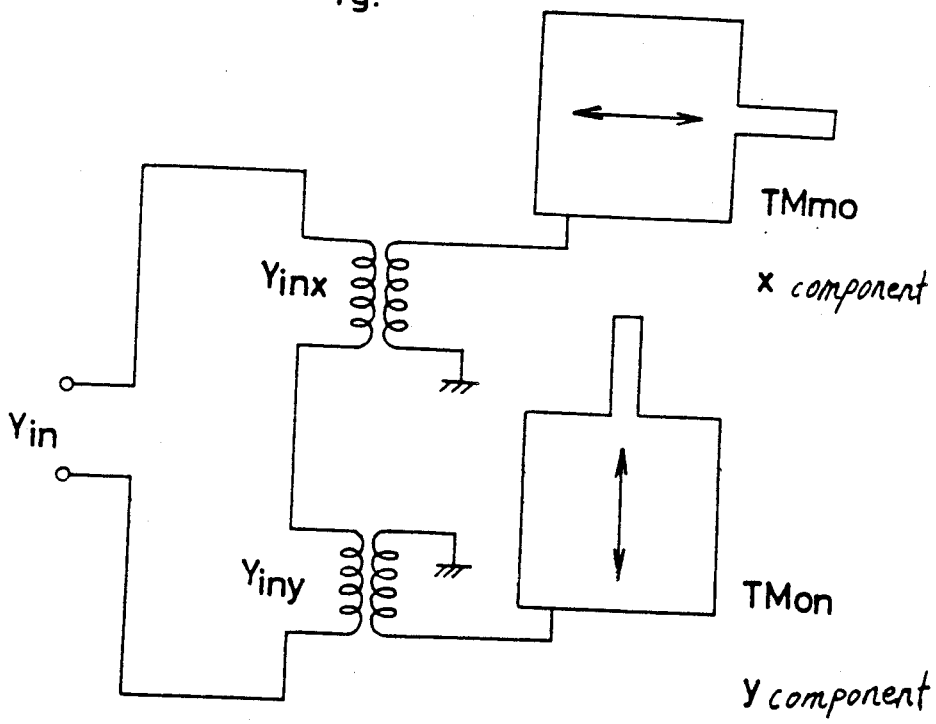
FIG. 5 is an electric circuit equivalent to a microstrip antenna shown in FIG. 1*a*.

An antenna shown in FIG. 1*a* has an equivalent circuit which is shown in FIG. 5. The equivalent circuit in FIG. 5 shows that this antenna has an exciting antenna with $TM_{mo}$ mode and an exciting antenna with $TM_{on}$ mode separately. A requirement of having a polarized wave is independent of the place of an electric supply point. When the electric power is supplied on the side bc, an input admittance is the same as in formula (4), because $\beta\cdot l_1\simeq\pi$ and $G<<Y\times 1$, $Y\times 2$. In the same way, when the antenna is excited in $TM_{01}$ mode, there is a radiation of an electric wave from the sides cd and ab. These radiation conductances Gy1 and Gy2, a characteristic admittance Yy1 with respect to the side dc from the side ab, and a characteristic admittance Yy2 with respect to the side jm from the side ab are shown in the following formulas.

$$Yy1=\epsilon rei_1^{\frac{1}{2}}\cdot l_1/(120\pi\cdot t)=Y\times 1\ldots \quad (5)$$

$$Yy2=\epsilon rei_3^{\frac{1}{2}}\cdot l_3/(120\pi\cdot t)\ldots \quad (6)$$

$$Gy1=Gy2=G-Fc\cdot l_1^2/\{90\cdot\lambda o^2\}\ldots \quad (7)$$

wherein:

$$\epsilon rei_3=(\epsilon r+1)/2+(\epsilon r-1)/\{2(1+10t/l_3)^{\frac{1}{2}}\}$$

In the same way, when the electric power is supplied on the side ab, an input admittance Yiny is shown in the following formula:

$$Yiny\simeq 2G+j\ \{Ty1\cdot\tan(\beta\cdot l_1)+Yy2\cdot\tan(\beta\cdot l_1/2)\}\ldots \quad (8)$$

If the input admittances Yinx and Yiny have a 90 degree phase difference:

$$Yinx/Yiny=\pm j\ldots \quad (9)$$

A straight line radiation electric field component has the same size and 90 degree phase difference. Thus a polarized wave is obtained.

By substituting the formulas (4) and (8) into the formula (9), $$\tan(\beta\cdot l_1)=\{(Y\times 2+Yy2)/(2Y\times 1)\}\cdot\tan(\beta\cdot l_1/2)\ldots \quad (10)$$

$$4G=\mp(Yy2-Y\times 2)\cdot\tan(\beta\cdot l_1/2)\ldots \quad (11)$$

are obtained.

By solving the formula (10), the solution $\beta\cdot l_1$ adjacent to $\pi$ is:

$$\beta\cdot l_1=\pi\pm 2\tan^{-}\{(Y\times 2+Yy2)/(4Y\times 1+Y\times 2+Yy2)\}^{\frac{1}{2}}\ldots \quad (12)$$

There are two $\beta\cdot l_1$ values which solve the formula (10) in front and back of $\pi$. This means there are two frequencies which make a polarized wave. However, it is necessary to meet the conditions of the formula (11). Two frequencies $f_1$ and $f_2$ which make a polarized wave are shown in the following formulas wherein the frequency $f_0$ which shows $\beta\cdot l_1=\pi$ and a separation $2\Delta$:

$$f_1=f_0\cdot(1-\Delta)\ldots \quad (13)$$

$$f_2=f_0\cdot(1+\Delta)\ldots \quad (14)$$

A separation $2\Delta$ is shown in the following formula because of the formula (12):

$$2\Delta=(4/\pi)\cdot\tan^{-1}\{(Y\times 2+Yy2)/(4Y\times 1Y\times 2+Yy2)\}^{\frac{1}{2}}\ldots \quad (15)$$

By selecting directions of polarized waves that are opposite to each other, a frequency $f_1$ corresponds to $\beta\cdot l_1=\pi(1-\Delta)$ and a frequency $f_2$ corresponds to $\beta\cdot l_1=\pi(1+\Delta)$. For the frequency $f_1$, because $\tan(\beta\cdot l_1/2)>0$ meets with the lower code of the formula (11), when $Y\times 2$ Yy2 ($l_3>l_2$), the right circular polarized wave is obtained, and when $Y\times 2>Yy2$ ($P_3<P_2$), the left circular polarized wave is obtained. For the frequency $f_2$, because $\tan(\beta\cdot P_{\frac{1}{2}})<0$ meets with the upper code of the formula (11), when $Y\times 2<Yy2$ ($P_3<P_2$) the right circular polarized wave is obtained.

In the second embodiment, the dielectric plate member 2 which has copper plates on the both sides has a dielectric constant $\epsilon r=2.50$. The radiation conductive plate member 1 is cut out from one side of the dielectric plate member 2 and the copper plate on the other side of the dielectric plate member 2 is used as the grounding conductive plate member 3.

In this case, the dimensions of the radiation conductive plate 1 shown in FIG. 1*a*, that is, $P_1$, $P_2$, and $P_3$ are 101.6 mm 1.33 mm, and 0.88 mm, respectively. The electric supply point 1*d* is set close to the diagonal line ac. At the electric supply point 1*d*, shown in FIG. 1*b*, the inner conductive portion of the coaxial line 4 is brazed with the radiation conductive plate 1 and the outer conductive portion of the coaxial line 4 is brazed with the earth conductive plate 3.

Figure 6:
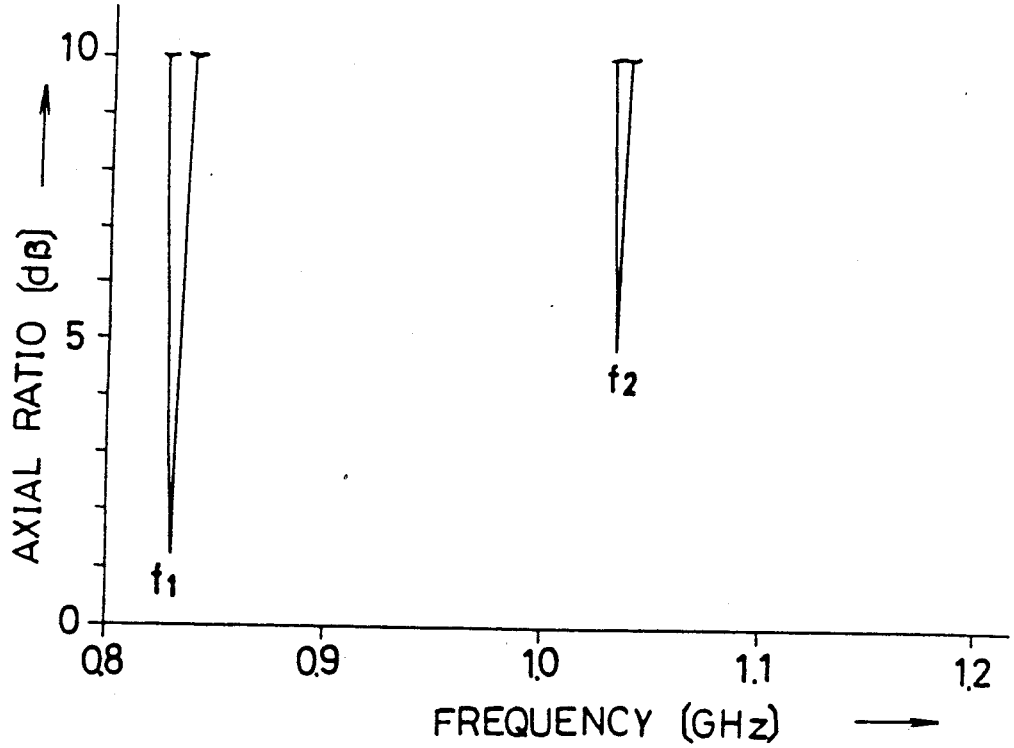
FIG. 6 is a graph showing a characteristic of the second embodiment of the present invention.

FIG. 6 is a graph which shows an axial ratio of the second embodiment of the polarized microstrip antenna. Referring to FIG. 6, both frequencies $f_1$ and $f_2$ show axial ratios which do not matter in practical applications. In the second embodiment, an opening line is used as a line load which connects the radiation conductive plate, but it is able to have some effect if a short line is used.

Various modifications within the spirit of the invention will be apparent to those of working skill in this area. Thus the invention is limited only by the scope of the appended claims.

What is claimed is:

1. A microstrip antenna comprising:

a dielectric plate member having two major surfaces and a thickness which is small compared to a wavelength of electromagnetic radiation, a rectangular radiation conductive plate member connected along one major surface of said dielectric plate member, a grounding conductive plate member connected along the other major surface of said dielectric plate member, an electric power supply point connected to the rectangular radiation conductive plate member through the dielectric plate member, and said rectangular radiation conductive plate member including first and second portions defined as line loads respectively extending from the middle of each of two adjacent sides of said rectangular radiation conductive plate member and in the same plane as said rectangular radiation conductive plate member, said first and second portions being sized so as to be resonant, and such that said microstrip antenna resonates at four different frequencies.

2. A microstrip antenna as recited in claim 1, wherein said first and second portions each comprise a rectangular conductive plate member which is symmetrical with respect to a center line of one side of said rectangular radiation conductive plate member.

3. A microstrip antenna comprising:

a dielectric plate member having two major surfaces and a thickness which is small compared to a wavelength of electromagnetic radiation, a rectangular radiation conductive plate member connected along one major surface of said dielectric plate member, a grounding conductive plate member connected along the other major surface of said dielectric plate member, a single electric power supply point connected to the rectangular radiation conductive member through the dielectric plate member, and said rectangular radiation conductive plate member including first and second portions defined as line loads respectively extending from the middle of each of two adjacent sides of said rectangular radiation conductive plate member, and in the same plane as said rectangular radiation conductive plate member, said first and second portions further being sized so as to be resonant so as to produce a 90 degree phase difference in input admittance in a parallel exciting mode which is parallel to the two adjacent sides.

4. A microstrip antenna as recited in claim 3, wherein said first and second portions each comprise a rectangular conductive plate member which is symmetrical with respect to the center line of one side of said rectangular radiation conductive plate member.

5. A microstrip antenna as recited in claim 3, wherein said first and second portions are configured such that said microstrip antenna performs said frequency polarization at at least two different frequencies.

* * * * *